US005078016A

United States Patent [19]

Russo

[11] Patent Number: 5,078,016

[45] Date of Patent: Jan. 7, 1992

[54] TWO PIECE LOAD CELL PIN

[75] Inventor: Thomas J. Russo, Kingsville, Md.

[73] Assignee: Bethlehem Steel Corporation, Bethlehem, Pa.

[21] Appl. No.: 619,958

[22] Filed: Nov. 30, 1990

Related U.S. Application Data

[62] Division of Ser. No. 365,819, Jun. 14, 1989, Pat. No. 5,014,393.

[51] Int. Cl.[5] ..... G01L 5/00; G01L 1/22

[52] U.S. Cl. ..... 73/862.54; 73/862.65

[58] Field of Search ..... 73/862.54, 862.57, 862.65, 73/862.66; 177/211

[56] References Cited

U.S. PATENT DOCUMENTS 3,695,096 10/1972 Kutsay ..... 73/862.66 X
3,754,610 8/1973 Paelian et al. ..... 177/211
3,827,514 8/1974 Bradley ..... 177/211 X
3,857,452 12/1974 Hartman ..... 73/862.54 X
3,992,934 11/1976 Clark ..... 73/862.54 X
4,421,186 12/1983 Bradley ..... 73/862.66 X
4,576,053 3/1986 Hatamura ..... 73/862.66

FOREIGN PATENT DOCUMENTS 1577341 10/1980 United Kingdom ..... 73/862.66

*Primary Examiner*—Charles A. Ruehl
*Attorney, Agent, or Firm*—Shlesinger Arkwright & Garvey

[57] ABSTRACT

A pivot pin including a hollow tubular sleeve having open ends for encircling a removable load cell having strain gauges attached thereto for measuring loads on a pivot joint. When loads are placed on a pivot joint the load cell will deflect and its deflections are detected by a strain gauge which measures the axial deflection of the load cell.

15 Claims, 6 Drawing Sheets

TWO PIECE LOAD CELL PIN

This is a division of application Ser. No. 07/365,819, filed June 14, 1989, now U.S. Pat. No. 5,014,393.

FIELD OF THE INVENTION

This invention relates to a pivot pin assembly for insertion into a pivot joint and including a strain gauge means for detecting loads applied to the pivot joint.

HISTORICAL BACKGROUND

Load cells capable of sensing and measuring forces are known in the art. Force measurement may be accomplished by using a strain gauge which converts mechanical motion to an electrical signal. By forming a pattern of resistor elements on the exterior surface of a load sensing device, deformation of the device as a result of applied load can be measured as a function of the change in resistance of the resistor elements as they are stretched or compressed. The change in resistance is measured by a Wheatstone bridge circuit which may be formed on the surface of the load sensing device.

OBJECTS AND SUMMARY OF THE INVENTION

It is an object of this invention to provide an improved pivot pin having means for measuring dynamic loads with a high degree of accuracy, while providing significant mechanical protection to the delicate strain gauges and connecting leads.

Yet another object of this invention is to provide a dumbbell shaped load cell for insertion inside a tubular sleeve in a pivot joint.

It is yet another object of this invention to provide strain gauges mounted in recessed portions of the dumbbell shaped load cell electrically connected to a display device for displaying the stresses measured by the strain gauges.

Still another object of the present invention is to provide a load cell of a shape which is complementary to the interior of the sleeve such that a frictional contacting fit is obtained between the outside walls of the load cell and the interior of the tubular sleeve.

It is another object of the present invention to provide a sleeve having a tapered inside surface and said load cell having a tapered outside surface such that when the load cell is inserted in the sleeve, the walls of the load cell contact the interior walls of the sleeve and when removal of the load cell is desired, a small displacement towards the larger open end of the sleeve will free the load cell and continued removal is easily facilitated.

In summary therefore, the pivot pin of this invention is directed to a dumbbell shaped portion with strain gauges mounted thereon and designed for insertion inside a protective tubular sleeve. The pin is designed for insertion into a pivot point connection of machinery so that dynamic loads and stresses placed on the pivot point can be measured. The dumbbell shape allows strain gauges to be mounted in recessed areas so that forces applied to the pivot pin are not applied directly to the strain gauge surface. The two piece design of the pivot pin allows the dumbbell shaped portion and strain gauges to be removed for repair or replacement leaving the tubular sleeve in place thereby leaving the pivot bearings undisturbed.

These and other objects and advantages of the invention will be readily apparent in view of the following description and drawings of the above described invention.

BRIEF DESCRIPTION OF THE DRAWINGS

The above and other objects and advantages and helpful features of the present invention will become apparent from the following detailed description of the invention illustrated in the accompanying drawings, wherein.

DETAILED DESCRIPTION OF THE INVENTION

Figure 1:
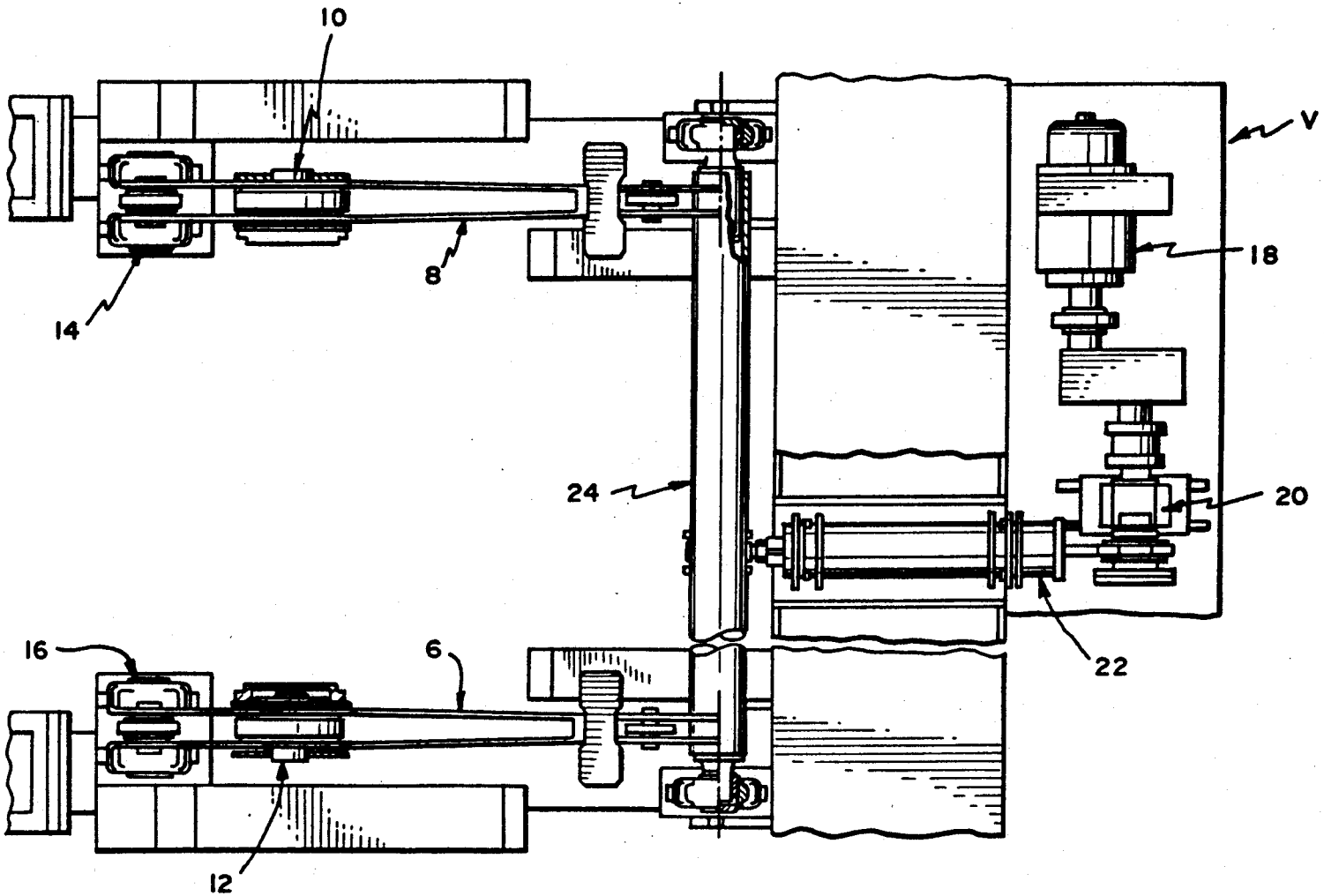
FIG. 1 is a top elevation of a continuous caster vibrating assembly, portions of which are broken away showing in cross section the continuous caster mounting assembly and part of the vibrating mechanism and showing a cross bar of indeterminant length.
Figure 2:
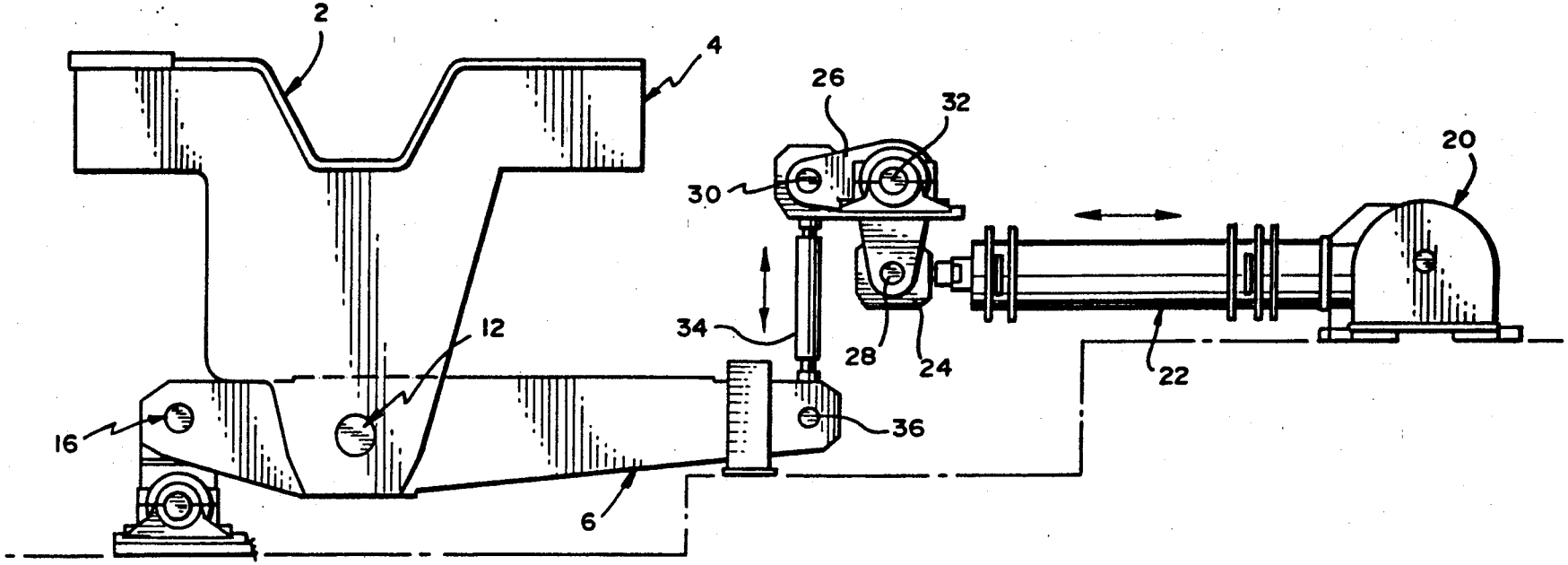
FIG. 2 is a side elevation of the continuous caster vibrating mechanism shown in FIG. 1.

Referring now to FIGS. 1–2, a vibrating mechanism V of a continuous casting assembly is shown and will be described in detail. In the continuous casting steel manufactoring process, molten steel is poured into the mold 2, mold table 4 supports mold 2 and is in turn supported by a pair of lever arms 6 and 8 at each end thereof by connection of pivot pins 10 and 12. Lever arms 6 and 8 are pivotally supported at ends 14 and 16, respectively.

In order to prevent molten steel from adhering to the walls of mold 2, it is necessary that the mold be constantly vibrated. This is accomplished by the vibrating mechanism V which consists of, as best shown in FIG. 1, a generator 18 connected to an eccentric oscillator 20 which provides a shaking action to bar 22 which is attached to cross bar 24 so that the vibrating action may be imparted to both lever arms 6 and 8. The connection between cross bar 24 and lever arms 6 and 8 transfers the vibrating motion from a horizontal plane to a vertical plane.

L-shaped pivoted member 26, as best shown in FIG. 2, includes pivot points at each end 28 and 30 and at central location 32. The horizontal movement of bar 22 correspondingly imparts a horizontal motion to pivot point 28 and is transformed to a vertical motion at pivot point 30 by L-shaped member 26. Vertical post 34 is pivotally connected at each end at pivot points 30 and 36. The vertical vibration of pivot point 30 causes post 34 to impart a vertical vibrating action at pivot point 36, thereby vertically vibrating lever arm 6. The vertical vibration on lever arm 6 causes a vibration in mold 2 and prevents the molten steel from adhering to its walls. In order to keep mold 2 in horizontally level orientation, it is necessary to provide pivot pin assemblies 10 and 12 where mold table 4 is pivotally connected to lever arms 6 and 8, respectively.

Figure 3:
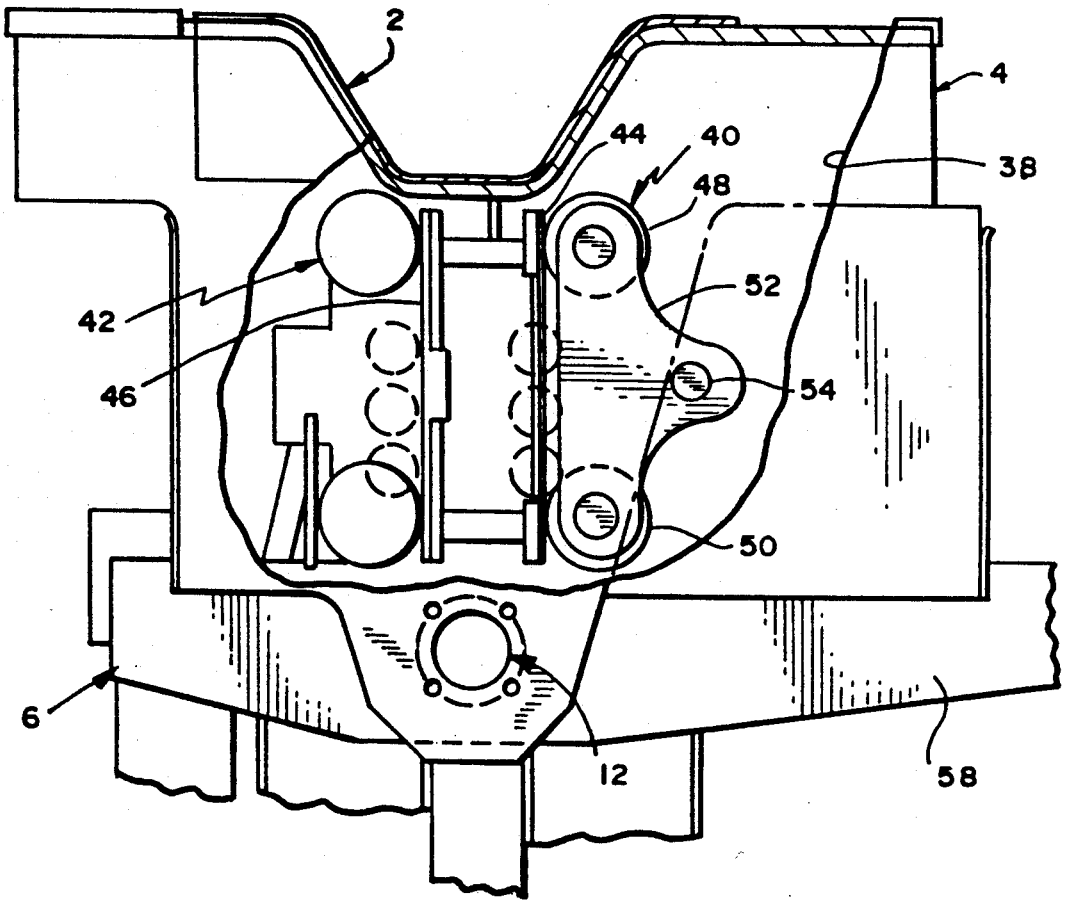
FIG. 3 is an enlarged fragmentary side elevation of the continuous caster mold table with a portion of the covering plate broken away to show the interior mechanism.

As best shown in FIG. 3, lever arm 6 supports mold table 4 by connection at pivot pin assembly 12. A portion of the exterior casing 38 has been broken away to reveal the support structure of mold table 4 which keeps the bottom wall of mold 2 horizontal when lever arm 6 is vertically vibrating mold table 4. When lever arm 6 is vibrating, the arm 6 travels in a short arcuate path at pivot point 36. Since the path is arcuate, it is necessary to have pivot pin assemblies 10 and 12 to allow mold table 4 to pivot so that mold 2 only moves vertically.

In order to allow vertical movement of mold table 4 while restricting horizontal movement, a system of guide rollers 40 and 42 and guides 44 and 46 are used in combination with mold table 4. Guide rollers 40 and 42 are anchored independently of mold table 4 in order that mold table attached guides 44 and 46 are allowed to move only in a vertical direction and are restrained from horizontal movement by guide rollers 40 and 42, respectively. In FIG. 3, guide roller 40 includes two rollers 48 and 50 connected for pivotal movement by rigid support member 52 which is anchored at 54. Guide 44 has a smooth vertical surface which contacts rollers 48 and 50 as mold table 4 vibrates up and down and prevents side to side motion of mold table 4. As rollers 40 and 42 and guides 44 and 46 wear out, additional vibrations occur. These vibrations cause additional stresses on pivot pin assemblies 10 and 12 which can be measured.

Figure 4:
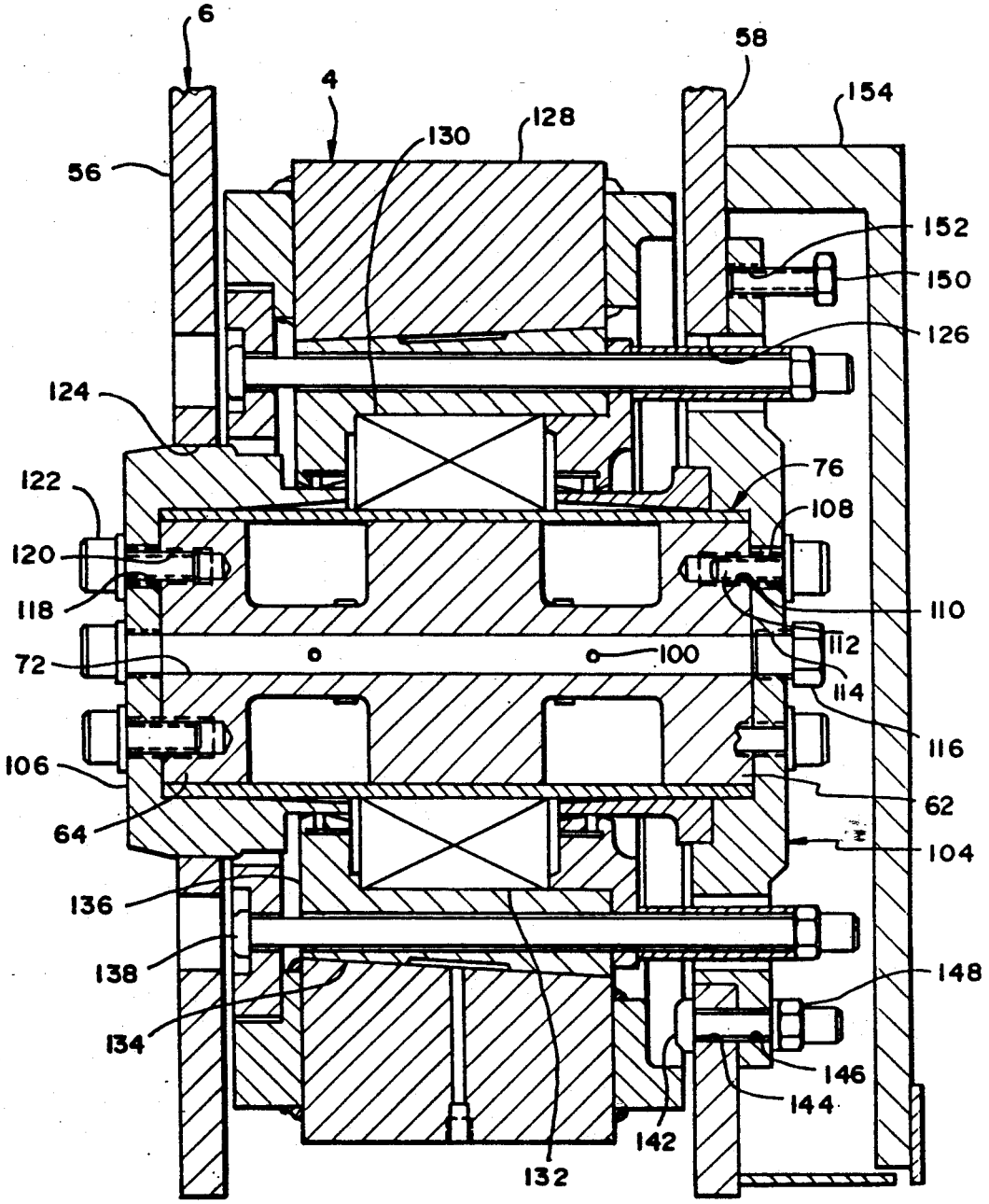
FIG. 4 is a cross-sectional view of the pivot pin assembly as installed in a pivot joint of a continuous caster.

FIG. 4 is a cross sectional view of pivot pin assembly 12 providing a pivotal connection between lever arm 6 and mold table 4. Pivot pin assembly 12 is surrounded by mold table 4 and extends axially between lever arm walls 56 and 58. Mold table 4 rests on and is supported by pivot pin assembly 12. Each end of pivot pin assembly 12 rests on lever arm walls 56 and 58 such that mold table 4 does not come in contact with lever arm 6.

Figure 5:
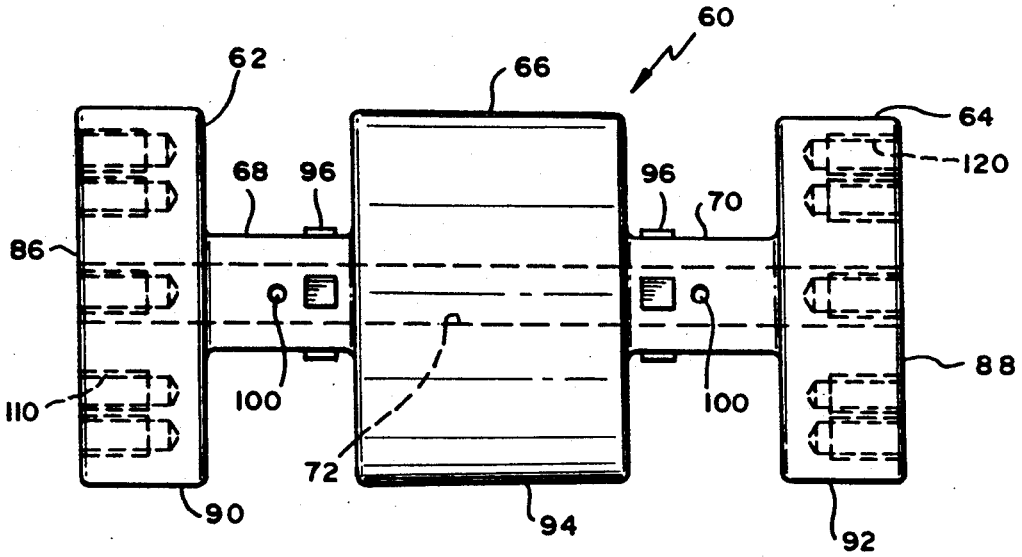
FIG. 5 is a side elevation of the dumbbell shaped portion of the pivot pin assembly.
Figure 6:
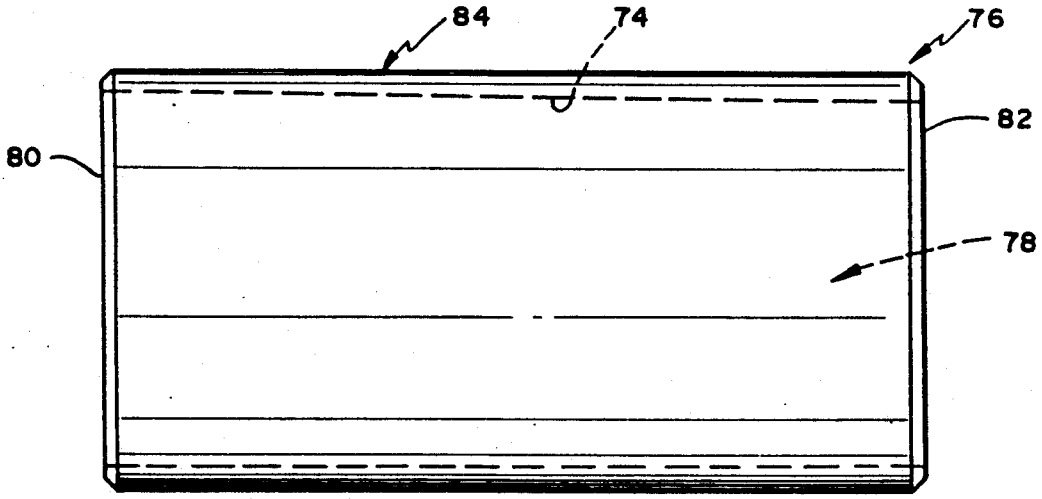
FIG. 6 is a side elevation of the sleeve portion of the pivot pin assembly.

The pivot pin assembly 12 includes a dumbbell shaped load cell 60 as best shown in FIG. 5. Load cell 60 includes a pair of end sections 62 and 64 and a middle section 66. End sections 62 and 64 are nearly equal in thickness and middle section 66 is thicker than end sections 62 and 64. Each of end sections 62 and 64 is joined to middle section 66 by portions 68 and 70, respectively, of smaller dimension than end sections 62 and 64 and middle section 66. Portions 68 and 70 are of reduced dimension to provide areas which will not be subjected to directly applied surface loads. Cavity 72 is located along a longitudinal axis through load cell 60. Sections 62 and 64 and 66 and portions 68 and 70 may be of any cross sectional geometrical shape which corresponds to the inside surface shape of sleeve 76 as shown in FIG. 6. The preferred cross sectional shape of load cell 60 and inside surface 74 of sleeve 76 is circular.

Sleeve 76 encloses a hollow interior 78 bounded by interior surface 74. Hollow interior 78 may be of uniform diameter from one end 80 of sleeve 76 to the other end 82 of sleeve 76, but preferably, inside surface 74 of sleeve 76 is tapered such that a hollow interior 78 is formed which has a larger diameter at end 80 and a smaller diameter at other end 82. Outside surface 84 of sleeve 76 is of uniform diameter from end 80 to other end 82 of sleeve 76.

Load cell 60 may be formed having a constant uniform diameter of individual sections 62 and 64 and 66 corresponding to interior 78 when interior 78 is of constant uniform diameter such that, load cell 60 may be inserted into sleeve 76 and a close fit is obtained between inside surface 74 and load cell sections 62 and 64 and 66. Preferably, load cell sections 62 and 64 and 66 are tapered to correspond to a tapered inside surface 74 of sleeve 76. When load cell 60 is of a tapered configuration, outside wall 86 of load cell end section 62 will be of a larger cross sectional diameter than outside wall 88 of load cell end section 64 and each of load cell sections 62 and 64 and 66 are gradually tapered such that a uniform taper occurs between outside wall 86 and outside wall 88 and the outside surfaces 90 and 92 and 94 of load cell sections 62 and 64 and 66, respectively, entirely contact inside surface 74 when load cell 60 is fully inserted into sleeve 76.

Strain gauges 96 are mounted on portions 68 and 70 at locations which allow stresses applied to the load cell to be measured. For example, friction between mold 2 and the molten steel causes stresses on load cell 60 which can be measured. Electrical connection devices 98, such as wires, extend from strain gauges 96 and into holes 100 which provide a passage to cavity 72. Cavity 72 provides a conduit through which the electrical connection devices 98 can extend to a power supply and a readout device (not shown). To prevent electrical connection devices 98 from being accidentally disconnected from strain gauges 96, straps 102 are provided to secure electrical connection devices 98 to portions 68 and 70. Strain gauges 96 are arranged such that axial forces on portions 68 and 70 can be detected. Any number of strain gauges 96 may be used depending on the accuracy of the measurement desired. Preferably, at least two strain gauges 96 spaced 90 degrees apart are located on each portion 68 and 70. Extra strain gauges 96 may be applied to provide spares when a regular strain gauge malfunctions.

Figure 7:
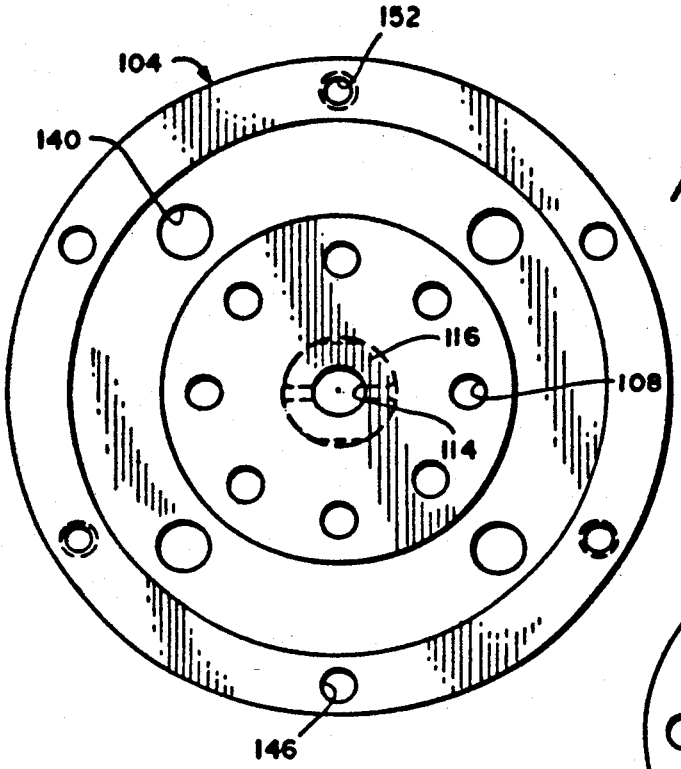
FIGS. 7 and 8 are side elevations of the end caps used in retaining the pivot pin in the pivot joint.
Figure 8:
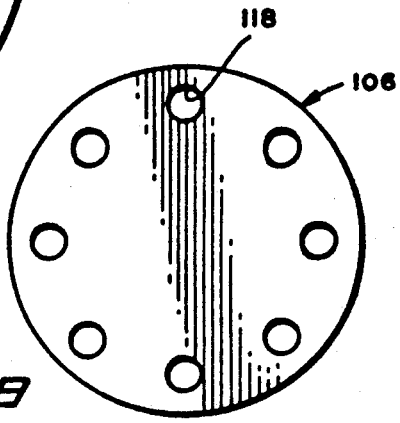
Figure 9:
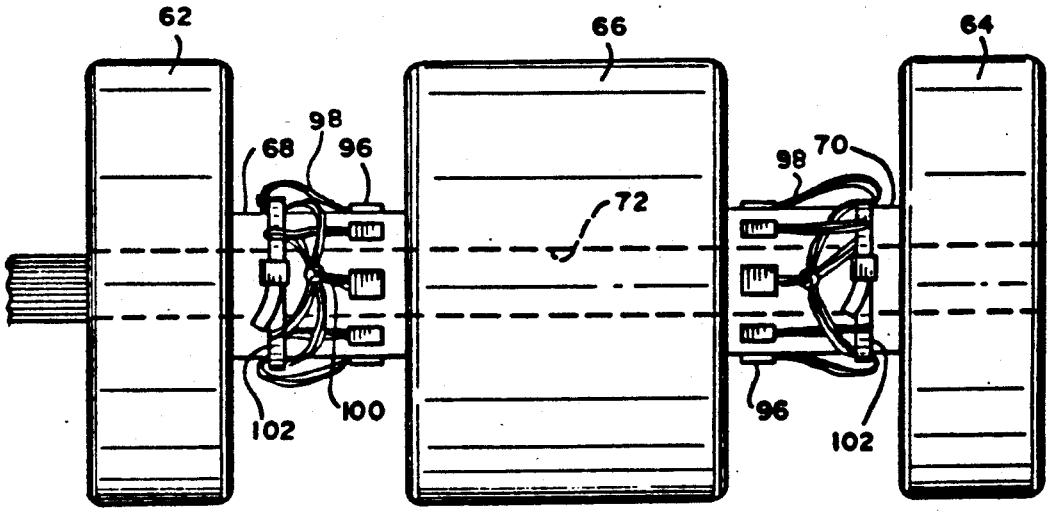
FIG. 9 is a side elevation of the dumbbell shaped portion of the pivot pin assembly and showing a series of strain gauges attached thereto.

End caps 104 and 106 are best shown in FIGS. 7 and 8, respectively. End cap 104 includes mounting holes 108 which correspond to threaded mounting holes 110 disposed on end section 62. Bolts 112 extend through end cap holes 108 to engage with threaded end section holes 110 to securely attach end cap 104 to load cell 60 as best shown in FIG. 4. Cap 104 also includes central opening 114 which allows passage of the electrical connection devices 98 extending from strain gauges 96 to pass out of cavity 72 to be connected with a readout device (not shown). A conduit connector 116 having an insulated throat is inserted in central opening 114 to prevent chafing of electrical connection devices 98. End cap 106 includes mounting holes 118 of complementary orientation to threaded end section holes 120 of end section 64. Bolts 122 connect end cap 106 to load cell 60 by passing through mounting holes 118 and threadably attaching to end section holes 120.

FIG. 4 shows a cross sectional view of pivot pin assembly 12 installed to provide a pivotal connection between lever arm 6 and mold table 4. Pivot pin assembly 12 extends between walls 56 and 58 of lever arm 6. Lever arm wall 56 includes an opening 124 which encircles load cell end section 64. Lever arm wall 58 includes an opening 126 which encircles load cell end section 62. Mold table 4 includes a central section 128 insertable between lever arm walls 56 and 58 and is spaced therefrom such that central section 128 does not contact lever arm walls 56 and 58. Mold table section 128 is entirely supported by pivot pin assembly 12.

A plurality of bearings 130 and 132 encircle pivot pin assembly 12 and support mold table central section 128 for pivotal movement relative to pin assembly 12 and lever arm 6. Bearings 130 and 132 are retained in position between sleeve 76 and mold table central section 128 by wedge-shaped member 134 and bearing support member 136. Bearing support member 136 and wedge-shaped member 134 are retained in position relative to each other by an elongated bolts 138. Bolts 138 extend through cap member 104 and are spaced therefrom as they pass through enlarged openings 140 which allow for movement when lever arm 6 is vibrating mold table 4. Sleeve 76 operates to retain bearings 130 and 132 in position when load cell 60 is removed for repair or replacement.

Bolts 142 pass through holes 144 in lever arm wall 58 and also pass through holes 146 in end cap 104 and are fastened by nuts 148 to join end cap 104 to lever arm wall 58. Bolts 150 are inserted into threaded openings 152 and bear against lever arm wall 58 when being screwed into holes 152 to force end cap 104 away from lever arm wall 58 when removal of load cell 60 is desired.

When it is desired to remove load cell 60 from sleeve 76, threaded bolts 122 are removed from load cell 60 and nut 148 is removed from bolt 142, then bolt 150 is screwed in to bear against lever arm wall 58 and force end cap 104 away from lever arm wall 58, then load cell 60 can be removed from sleeve 76. When using a tapered configuration of load cell 60 complementary to a tapered hollow interior 78 of sleeve 76, wherein end 62 is larger in diameter than end 64, once the frictional contact between inside surface 74 and load cell surfaces 90 and 92 and 94 is broken, load cell 60 may be easily removed from sleeve 76.

Casing 154 is a covering for protecting electrical connection devices 98 as they extend through central opening 114 of end cap 104.

It should be understood that while the pivot pin assembly has been described as being used in a continuous caster vibrator mechanism V, the pivot pin assembly may be applied in other pivot joints in which it is necessary or desirable to measure stresses from loads applied thereon.

While this invention has been described as having a preferred embodiment, it is understood that it is capable of further modification, uses and/or adaptations of the invention follow in general the principle of the invention and including such departures from the present disclosure as come within known or customary practice in the art to which the invention pertains, and as may be applied to the central features herein before set forth, and fall within the scope of the invention of the limits of the appended claims.

What we claim is:

1. A pivot pin, comprising:

a) a hollow tubular sleeve having open ends, said sleeve has a uniform outside surface diameter from a first open end to a second open end, and said sleeve has a tapered inside surface such that said inside surface has a larger diameter at said first open end and a smaller diameter at said second open end;

b) said sleeve having a longitudinal axis;

c) a removable load cell, positionable inside said hollow tubular sleeve, and extending substantially the length of said sleeve and having a longitudinal axis; and, d) strain gauge means associated with said cell for measuring axial deflection of said pin.

2. The pivot pin of claim 1, wherein:

a) said load cell is of a tubular shape.

3. The pivot pin of claim 1, wherein:

a) said load cell includes a first end section, a middle section and a second end section; and, b) each section being of a dimension corresponding to an inside dimension of said hollow tubular sleeve such that a close fit may be obtained between said load cell and said sleeve when said load cell is fully inserted in said sleeve.

4. The pivot pin of claim 3, wherein said load cell includes:

a) portions of smaller dimension located between said first end section and said middle section and between said second end section and said middle section.

5. The pivot pin of claim 4, wherein:

a) said strain gauge means is mounted to said portions; and including, b) means for connection of said strain gauge means to a display device which can compute stresses on said load cell and display the result from a signal produced by and received from said strain gauge.

6. The pivot pin of claim 4, further including:

a) a cavity extending axially through said load cell;

b) at least one strain gauge means located on at least one of said portions for measuring stresses applied to said load cell;

c) said strain gauge means having means for electrically connecting said strain gauge means to a power source; and, d) said electrical connection means extending from said strain gauge means through a hole in one of said portions to said cavity and through said cavity for connection to the power source.

7. The pivot pin of claim 4, wherein:

a) said portions of smaller dimension are substantially equal in length.

8. The pivot pin of claim 4, wherein:

a) said strain gauge means are positioned circumferentially of said portions of smaller dimension; and, b) said strain gauge means are spaced apart 90 degrees in order to provide a two-dimensional flexure measurement.

9. The pivot pin of claim 4, wherein:

a) said load cell includes a cavity extending substantially longitudinally therethrough;

b) each of said portions of smaller dimension has a hole means for permitting an electrical connection means to extend from said strain gauge means through said hole means and into said cavity; and, c) said connection means extending through said cavity for connection to a display means.

10. The pivot pin of claim 4, wherein:

a) each of said sections has a predetermined width; and, b) said middle section has a width which is double that of said end sections.

11. The pivot pin of claim 10, wherein:

a) said strain gauge means is positioned on each of said recessed areas; and, b) said strain gauge means is positioned closer to said middle section than said end sections.

12. The pivot pin of claim 3, further comprising:

a) at least two recessed areas located next to said middle section.

13. The pivot pin of claim 12, wherein:

a) said strain gauge means are positioned on each of said recessed areas.

14. The pivot pin of claim 1, wherein:

a) said load cell comprises a plurality of spaced apart sections; and, b) areas of reduced dimension are positioned between each of said spaced apart sections.

15. The pivot pin of claim 14, wherein:

a) said strain gauge means is positioned on said areas of reduced dimension.

* * * * *